United States Patent [19]

Best

[11] 4,189,000

[45] Feb. 19, 1980

[54] CASING SCRAPER

[76] Inventor: David M. Best, P.O. Box 14273, Houston, Tex. 77021

[21] Appl. No.: 918,922

[22] Filed: Jun. 26, 1978

[51] Int. Cl.[2] ..... E21B 37/02

[52] U.S. Cl. ..... 166/173; 175/411; 285/422

[58] Field of Search ..... 166/173, 241, 174, 170; 175/325, 411; 285/45, 286, 22

[56] References Cited

U.S. PATENT DOCUMENTS

| | | | |
|---|---|---|---|
| 2,128,111 | 8/1938 | Woods | 285/45 |
| 2,836,251 | 5/1958 | Claypool et al. | 166/173 |
| 3,032,114 | 5/1962 | Best | 166/173 |
| 3,158,214 | 11/1964 | Wisler et al. | 175/375 |
| 3,338,069 | 8/1967 | Ortloff | 175/320 |

*Primary Examiner*—William F. Pate, III
*Attorney, Agent, or Firm*—Jack W. Hayden

[57] ABSTRACT

A casing scraper includes an elongated hollow mandrel with upper and lower longitudinally, circumferentially extending receptacles. Scraper blade means formed by a plurality of longitudinally and circumferentially extending scraper blades are provided in each receptacle with resilient means tending to urge each of the scraper blades radially outward from the mandrel. The upper receptacles are circumferentially offset relative to the lower receptacles so that the scraper blade means in the upper receptacles overlap the scraper blade means in the lower receptacles. Hold down rings are provided adjacent the upper end of the upper receptacles and the lower end of the lower receptacles for retaining the scraper blade means in the receptacles and the hold down rings are provided with a cutting metal surface adjacent an end of each ring. A ring fits about the mandrel between the upper and lower receptacles to further aid in retaining the spring loaded blades in position on the casing scraper. The ring is split for assembly and then welded together so it floats on the mandrel, and it is provided with removable portions at each end thereof for access to the scraper blade means in the receptacles for placement and removal thereof.

6 Claims, 5 Drawing Figures

CASING SCRAPER

SUMMARY OF THE INVENTION

The present invention relates to an improvement over the structure shown in U.S. Pat. No. 3,032,114. Damage to casing scrapers during use occurs because junk is present in the well bore, or falls in the well bore because of pieces of retainer packer being drilled up which are too large to be pumped to the surface so that such pieces either fall back on the casing scraper of "gang up" adjacent the scraper causing damage to ring sections and damage to the cutter blades.

Additionally, if a bit of improper small size is employed in drilling out a plug in a well bore, subsequent use of the casing scraper in the well bore is "over worked" that is it in effect drills out the plug portions which the bit missed thus causing additional damage to the scraper.

To overcome the above problems, the present invention employs a cutting material such as tool steel or carbide applied to selected areas of the casing scraper to resist damage to the scraper and provide the scraper with an ability to withstand abrasive forces by reason of any wedging particles of junk acting on the scraper in the well bore.

The cutting material of tool steel or carbide further drills up large pieces of cuttings and junk which tends to gang up or collect at the top of the scraper tool in the well bore as the scraper is actuated to drill or scrape downwardly in the well pipe in the well bore.

As the scraper of the present invention is moved downwardly or drilled downwardly in the pipe, the cutting surfaces formed by the tool steel or carbide is employed to reduce large pieces of cutting, junk, cement and packer parts which have been missed by the bit so that such junk can be subsequently pumped along with the drilling fluid to the earth's surface. Such large pieces of junk can be reduced to a proper size without damaging the casing since the tool steel surfaces do not protrude radially from the scraper beyond the expanded blades and contact the casing as the scraper is actuated to reduce the particle size of the junk.

The cutting surfaces formed by the tool steel or carbides on the tool of the present invention are also positioned thereon in a manner so that aid is provided in breaking up any object that might otherwise hinder removal of the drill string through the casing. That is, any object wedged at the scraper tool of the present invention in a well string can be milled by the cutting surfaces including collapsed or partially collapsed casing which may occur, either upwardly or downwardly.

Additionally, the present invention provides a central retainer ring between upper and lower circumferentially offset rows of cutting blades which is constructed and arranged to provide ready access to the cutting blades.

Generally speaking, all scrapers on the market at the present time scrape multiple weights of casing for each blade size. Each casing weight in any given casing size has a different internal diameter which means that the cutter blades of the prior art may not conform to the internal diameter arc of the casing in most instances. Since one of the objects of a casing scraper is to provide a clean, non-burred internal casing surface to inhibit damage to the packer when it is subsequently run into the well bore, it can be appreciated that where the same scraper is used on all casing weights within a certain size such scrapers may provide only line or tangential contact between the cutting blades and the internal casing surface as opposed to the blades conforming to the radius of curvature of the casing.

Thus, substantial exposed portions of the casing may not be contacted, or may be improperly contacted by the cutting blades. To overcome this problem, the present casing scraper employs cutter blade means in spaced rows of receptacles offset circumferentially and which cutter blade means is formed by a plurality of longitudinally separated, circumferentially extending cutter blades in each receptacle. Each blade is independently and resiliently urged outwardly into contact with the casing and thus, regardless of the casing weight in any given size casing, the plurality of blades in each receptacle tend to more nearly conform with the internal diameter of the pipe being scraped and substantially increases the amount of internal surface area of the casing or well pipe which is scraped and cleaned.

Other objects and advantages of the present invention will become more readily apparent from a consideration of the following drawings and description.

DESCRIPTION OF THE PREFERRED EMBODIMENT

Figure 2:
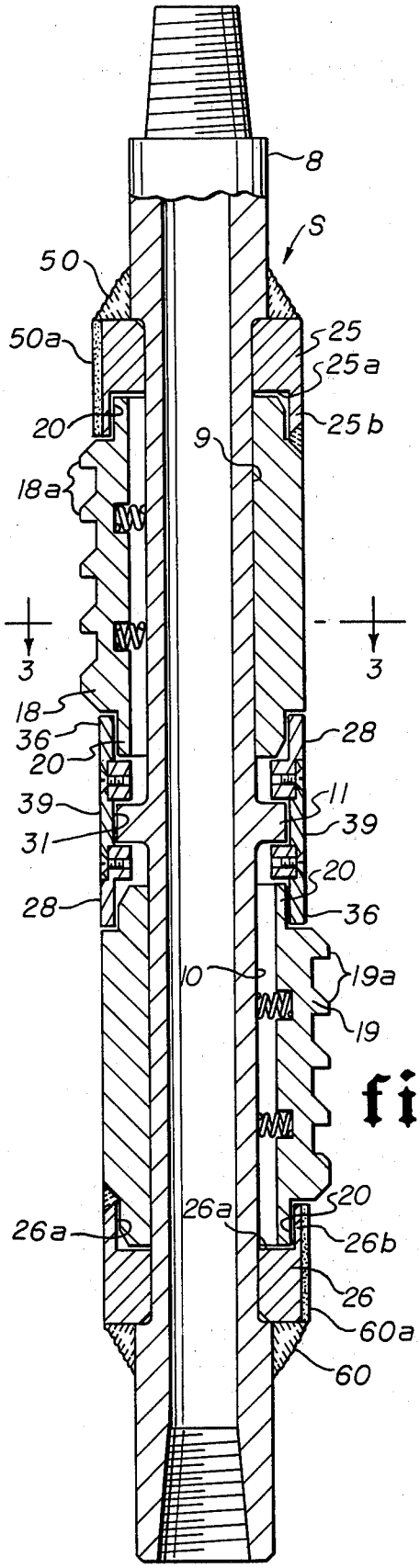
FIG. 2 is a vertical sectional view of the casing scraper of the present invention.

Attention is first directed to FIG. 2 wherein the scraper of the present invention is referred to by the letter S. It includes an elongated hollow mandrel 8 having longitudinally and circumferentially extending upper and lower recesses 9 and 10. An annular outwardly extending shoulder 11 on the mandrel 8 separates the upper and lower recesses 9 and 10. Circumferentially spaced, longitudinally extending spacers 13 are mounted in each of the upper and lower recesses and secured to the mandrel 8 in any suitable manner such as by welding or the like. It will be noted that the spacers 13 in the upper recess 9 are offset circumferentially from the spacers 13 in the lower recess 10 to provide receptacles 15 which are also offset circumferentially and extend between the spacers 13 in each of the recesses 9 and 10 as shown. The offset arrangement of the receptacles 15 in the recesses 9 and 10 generally longitudinally aligns a receptacle 15 in the recess 9 with a spacer 13 in the recess 10 therebeneath as illustrated in the drawings.

Figure 3:
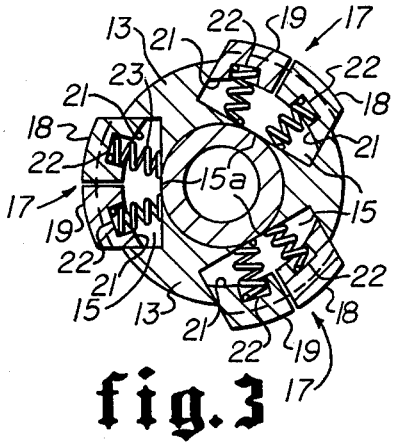
FIG. 3 is a sectional view on the line 3—3 of FIG. 2 illustrating the arrangement of the segmented blade means in each receptacle.

As illustrated in FIG. 3, each recess 9 and 10 employs three receptacles 15 and three spacers 13. Scraper blade means as referred to generally at 17 are provided in each receptacle, such scraper blade means including a plurality of longitudinally and circumferentially extending blades 18 and 19 in each recess 15. Each of the blades 18 and 19 are provided with annular end portions 20 which are recessed relative to the radially and circumferentially projecting blades 18*a*. It will be noted that the blades 18*a* are longitudinally spaced on the scraper blades 18 and 19 as shown. Additionally, each of the blades 18 and 19 is provided with a nether surface 21 in which is formed a spring seating surface means 22 which may be of any suitable configuration to receive the form of spring means employed with the present invention to urge the scraper blades 18 and 19 radially outwardly of the recesses 9 and 10.

As illustrated in FIG. 3 such spring means is shown as being in the form of coil springs 23 one end of which abuts the spring seating surface 22 and the other end of which rests on the inner receptacles surface 15*a*.

Suitable means are provided for aiding in limiting the outward radial movement of the blades 18 and 19 relative to the mandrel 8 in the form of annular end hold down rings 25 and 26 which are secured to the mandrel 8 adjacent the ends of the recesses 9 and 10 by any suitable means such as welding or the like. The hold down rings 25 and 26 include an annular counterbore 25*a* and 26*a* respectively which provides a lip forming a receptacle 25*b* and 26*b* for overhanging one of the recessed end portions 20 of the scraper blades 18 and 19.

The retaining means for the scraper blades 18 and 19 also includes a central hold down ring 28 which may be formed of split sections that are welded together after assembly on the mandrel 8. A central recess 31 is provided in the center hold down ring for surrounding the annular shoulder 11 to assist in positioning and retaining the central hold down ring in position during use of the scraper tool, but which enables the ring 28 to rotate on the mandrel.

Figure 4:
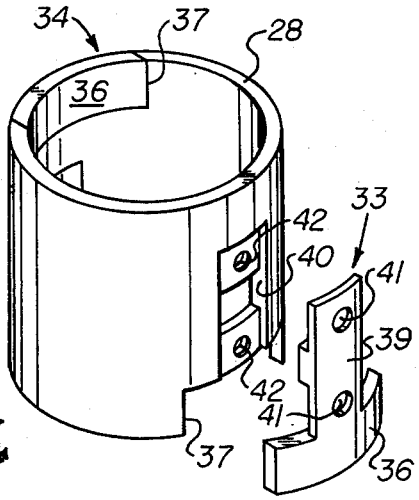
FIG. 4 is a perspective view illustrating the preferred form of the center hold down ring.

The details of the central retainer ring 28 are shown in FIG. 4 of the drawings wherein such ring is shown in its assembled relationship and includes portions referred to generally at 33 and 34 adjacent each end portion to provide access, upon rotation of the ring 28, to the scraper blades for removal and replacement thereof without the necessity of removing the complete hold down ring 28 from the mandrel 8. It will be noted that the portions 33 and 34 are generally T-shaped as shown, one portion 36 of each T extending circumferentially adjacent the ends of the ring in diametrically opposed relationship as shown. Each portion 36 is received in circumferentially extending slot 37 formed in each end of the ring 28. The longitudinally extending portion 39 of each T section is adapted to be received in the longitudially extending groove or recess 40 formed in the outer surface of the ring 28. The portions 33 and 34 are secured in position on the ring by any suitable means such as screws which are received through the openings 41 in the portions 39 and into the threaded openings 42 in the longitudinally extending diametrically opposed recesses 40.

The end portions of the ring 28 overlap the other ends of the recesses 9 and 10 and the other recessed end portions 20 of the blades 18 and 19 to retain the blades in position on the scraper during use, but as noted the T-shaped arrangements cna be readily removed for access to the scraper blades for repair or replacement thereof without the necessity of removing the entire center ring 28.

Figure 5:
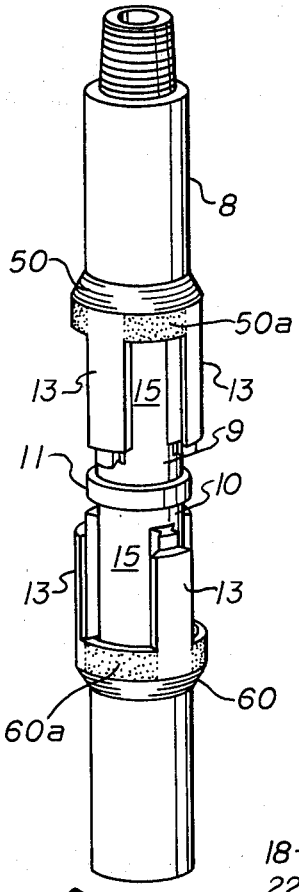
FIG. 5 is an elevational view of the mandrel of the present invention with the cutter blades and the central hold down ring removed to better illustrate structural details of the present invention.
Figure 1:
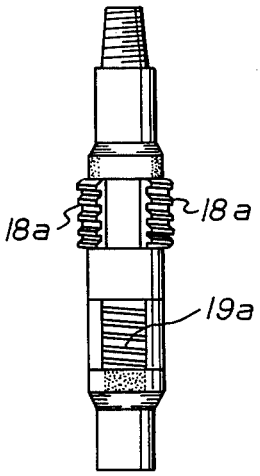
FIG. 1 is an elevational view of the preferred form of the casing scraper of the present invention.

Particular attention is directed to the cutting metal surfaces 50 and 60 adjacent the upper and lower end of the scraper tool as shown in FIGS. 1, 2 and 5 of the drawings. The cutting surfaces are formed by depositing tool steel or a suitable carbide cutting material by a method well known to those skilled in the art on the end of the annular shoulder of each of the hold down rings 25 and 26 and is preferably formed so that the cutting metal surfaces 50 and 60 extend annularly and are inclined inwardly from the outer end of each of the hold down rings 25 and 26 toward the outer surface of the mandrel 8 as shown. In addition, built up weld metal surfaces 50*a* and 60*a* are formed on each of the end hold down rings 25 and 26 to provide thickened, spaced circumferentially extending sections adjacent one end of each receptacle 9 and 10. The thickened section overlaps the ends of the blades 18 and 19 in the recesses as shown in FIGS. 1, 2 and 5 of the drawings. The outer annular surface of the thickened circumferential segments 50*a* and 60*a* is machined to make it smooth; thus the annular sections extend radially outwardly of the spacers 13 which separate the annular segments 50*a* and 60*a* as shown in the drawings. The purpose of the built up portions 50*a* and 60*a* is to increase the load bearing potential of the ring at these sections in a unique manner.

The plurality of cutting blades in each of the receptacles 15 and the associated spring means enables such cutter blades to expand radially in a manner to contact a greater circumferential portion of the internal surface area of the pipe through which the scraper tool of the present invention is moved even though the radius of curvature of the internal diameter for such pipe may change from one weight of pipe to another for any given size.

Also, the arrangement of the cutting metal surfaces 50 and 60 at the upper and lower ends of the tool enable such tool to mill or cut away burrs or projecting portions on the internal surface of the casing as well as reducing pieces of junk to a suitable size so that they may pump from the well bore, thus providing a smooth, clean interior pipe surface through which a packer may be lowered as the well is completed and substantially reducing the possibility of damage to such packer during this operation.

In addition, the built up sections 50*a* and 60*a* on the end hold down rings 25 and 26 inhibit damage thereto due to pieces of junk which might tend to bend the portion of such ring which overlaps the cutter blades, as has occurred with prior art devices. The built up sections may be more clearly seen in FIGS. 1, 2 and 5. It is not uncommon for junk to tend to become engaged between the cutter blades in such overhanging portion, and with hold down rings of the prior art, their construction has been such that they are more readily damaged than the hold down ring as disclosed in the present invention.

The foregoing disclosure and description of the invention are illustrative and explanatory thereof, and various changes in the size, shape, and material as well as in the details of the illustrated construction may be made without departing from the spirit of the invention.

What is claimed is:

1. A casing scraper for well pipe including:

a. an elongated hollow mandrel having longitudinally and circumferentially extending upper and lower recesses;

b. an annular shoulder on said mandrel separating said recesses;

c. circumferentially spaced longitudinally extending spacers mounted on said mandrel in each said upper and lower recess to form longitudinally extending receptacles in each said upper and lower recesses with the receptacles in one of the recesses being longitudinally aligned with the spacers in the other recess;

d. scraper blade means positioned in each of said receptacles, said scraper blade means being split longitudinally to provide a plurality of longitudinally extending scraper blades in each receptacle;

e. each of said scraper blades having annular recessed end portions;

f. each of said blades having spring seating surface means on their nether side;

g. spring means abutting said mandrel and said seating surface means to tend to urge each of said blades radially outward from said mandrel; and h. means to retain each of said blades in said receptacles, said means including:

1. end hold down ring means secured to said mandrel adjacent one end of each said upper and lower recesses and overlapping one of said annular recessed end portions on said blades; and 2. ring means engaging said annular shoulder and overlapping the other annular recessed end portions on said blades.

2. The casing scraper of claim 1 wherein said end hold down ring means are each provided with built up metal surfaces to provide thickened, spaced circumferentialy extending surface sections adjacent one end of each of said receptacles and which thickened sections overlap the recessed end portions of said scraper blade means, said thickened sections projecting radially beyond said circumferentially spaced spacers which extend between and separate said circumferentially extending, spaced thickened sections.

3.

The casing scraper of claims 1 or 2 wherein a cutting metal surface is formed adjacent the upper and lower end of said casing scraper by cutting material on the upper end of said hold down ring means which is adjacent the upper recess and by cutting material on the lower end of said hold down ring means which is adjacent the lower recess, said cutting material extending annularly and inwardly from the outer end of each of said rings to said mandrel.

4. The structure of claim 1, wherein said ring means includes removable portions at each end for access to said scraper blade means for removal and replacement.

5. The structure of claim 2 wherein said ring means includes removable portions at each end for access to said scraper blade means for removal and replacement.

6. The structure of claim 3 wherein said ring means includes removable portions at each end for access to said scraper blade means for removal and replacement.

* * * * *